United States Patent [19]

Baumann

[11] 4,335,259

[45] Jun. 15, 1982

[54] QUATERNIZED POLYAMINES

[75] Inventor: Hans-Peter Baumann, Ettingen, Switzerland

[73] Assignee: Sandoz Ltd., Basel, Switzerland

[21] Appl. No.: 222,483

[22] Filed: Jan. 5, 1981

Related U.S. Application Data

[63] Continuation-in-part of Ser. No. 50,881, Jun. 21, 1979, Pat. No. 4,297,296.

[30] Foreign Application Priority Data

Jun. 26, 1978 [CH] Switzerland ..... 6933/78

[51] Int. Cl.[3] ..... C07C 87/30

[52] U.S. Cl. ..... 564/290

[58] Field of Search ..... 564/290, 286; 8/606

[56] References Cited

U.S. PATENT DOCUMENTS

| | | | |
|---|---|---|---|
| 3,079,436 | 2/1963 | Hwa | 564/290 |
| 4,197,865 | 4/1980 | Jacquet et al. | 564/290 |
| 4,220,449 | 9/1980 | Baumann | 8/606 |

FOREIGN PATENT DOCUMENTS

| | | | |
|---|---|---|---|
| 1495473 | 12/1977 | United Kingdom | 564/290 |

*Primary Examiner*—Natalie Trousof
*Assistant Examiner*—James H. Reamer
*Attorney, Agent, or Firm*—Gerald D. Sharkin; Richard E. Vila; Thomas C. Doyle

[57] ABSTRACT

The present invention relates to quaternized polyamines having the basic structure of formula I,

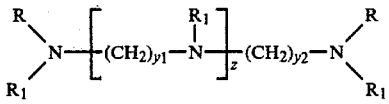

I in which each R independently, is ($C_{10-22}$)alkyl, ($C_{10-22}$)alkenyl, phenyl($C_{1-3}$)alkyl or naphthyl($C_{1-3}$)alkyl, each $R_1$, independently, is phenyl($C_{1-3}$)alkyl or naphthyl($C_{1-3}$)alkyl, z, is 1 to 5, each $y_1$, independently is an integer from 2 to 8, $y_2$, is an integer from 2 to 8, with the proviso that when $z=1$, $y_1 \neq y_2$ and when $z>1$ and the $y_1$'s are the same $y_2 \neq y_1$ and wherein an average of 0.5 to 2.0 nitrogen atoms are quaternized with alkyl radicals containing from 1 to 6 carbon atoms and mixtures of such quaternized polyamimes with further quaternized polyamines, such polyamines and mixtures being useful as dye retarders/-levelling agents.

11 Claims, No Drawings

QUATERNIZED POLYAMINES

This application is a continuation-in-part of co-pending application Ser. No. 50,881 filed June 21, 1979, now U.S. Pat. No. 4,297,296.

The invention relates to quaternized polyamines which are useful as dyeing aids.

More particularly, the present invention provides quaternized polyamines having the basic structure of formula I,

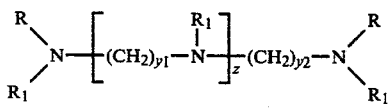

I in which each R, independently, is $(C_{10-22})$alkyl, $(C_{10-22})$alkenyl, phenyl$(C_{1-3})$alkyl or naphthyl $(C_{1-3})$alkyl, each $R_1$, independently, is phenyl$(C_{1-3})$alkyl or naphthyl $(C_{1-3})$alkyl, z is 1 to 5, each $y_1$, independently, is an integer from 2 to 8, $y_2$ is an integer from 2 to 8, with the proviso that when $z=1, y_1 \neq y_2$ and when $z>1$ and the $y_1$'s are the same $y_2 \neq y_1$ and wherein an average of 0.5 to 2.0 nitrogen atoms are quaternized with alkyl radicals containing from 1 to 6 carbon atoms.

Preferred quaternized amines are those having the basic structure of formula $I_a$,

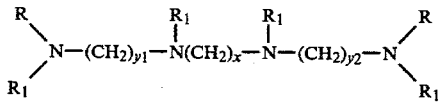

$I_a$ in which $y_1$ and $y_2$ are the same and are an integer from 2 to 8, x is an integer from 2 to 8 with the proviso that $x \neq y_1$, and $R_1$ and R are both benzyl.

More preferably, in the compounds of formula $I_a$, $y_1$ and $y_2$ are 3 and x is 2 or $y_1$ and $y_2$ are 2 and x is 3, especially the former.

The preferred quaternized amines are those which are quaternized with $(C_{1-4})$alkyl, especially methyl, groups.

Preferably an average of 0.5 to 1.8, more preferably 0.75 to 1.25 nitrogen atoms are quaternized.

The present invention further provides a process for the production of quaternized amines, as defined above, comprising quaternizing a compound of formula I, as defined above, with a sufficient amount of $(C_{1-6})$alkyl-containing quaternization agent to give a compound wherein an average of 0.5 to 2.0 nitrogen atoms are quaternized.

The quaternization reaction is carried out in accordance with known methods. The quaternization agents may be any of those commonly employed e.g. alkyl halides or sulphates especially dimethylsulphate. Preferably quaternization is effected at temperatures under 100° C.

The non-quaternized amines of formula I, may be prepared in accordance with the known methods.

Preferably the quaternized polyamines of the invention are employed in admixture with other quaternized polyamines. Thus, the present invention still further provides a mixture of quaternized amines comprising at least one amine of formula I, as given above and at least one amine of formula $I_x$,

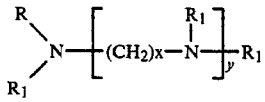

$I_x$ in which

R and $R_1$, respectively, are as defined in formula I, above, x is 2 to 8 and y is 1 to 5, and in such mixture an average of 0.5 to 2.0 nitrogen atoms in each amine are quaternized with $(C_{1-6})$alkyl radicals.

The non-quaternized amines of formula $I_x$ as well as such quaternized amines are either known or may be prepared as described in British Pat. No. 1,495,473 or analogously thereto.

The preferred mixture is one which contains an amine of formula $I_a$, particularly one in which $y_1$ and $y_2$ are 3 and x is 2, and a mixture of amines of formula $I_x$ in which R is $C_{14}$ to $C_{22}$alkyl, x is 3, y is 1 and each $R_1$ is benzyl, especially wherein on average 2 nitrogen atoms of each amine are quaternized with methyl groups.

Suitably these mixtures are quaternized simultaneously in the same reaction vessel.

The mol ratio of the compounds of formula $I_x$ to those of formula I in the mixtures of the invention is preferably 5:95 to 80:20, more preferably 40:60 to 60:40.

The quaternized amines of the present invention either alone or in admixture with the quaternized amines as mentioned above are useful as levelling agents or retarders in the dyeing of polyacrylonitrile fibres with basic dyestuffs, especially basic dyestuffs having K-values (compatability values) of 1 to 3.

The amount of levelling agent employed will depend on the nature of the polyacrylonitrile and on the amount and nature of the dyestuff employed. Thus, the amount employed may vary, for example from 0.02 to 2%, based on the weight of the substrate. With wet spun polyacrylonitrile amounts at the upper end of this range should be employed.

The quaternized compounds of formula I or the mixture according to the invention may be employed alone or in admixture with emulsifying agents and optionally, water. Preferably they are employed in the form of an aqueous emulsion. The preferred emulsifying agent is iso-octyl phenolpoly(10) glycolic ether. Such emulsions suitably contain from 15 to 30% by weight active ingredient with 15–40% emulsifier and the rest water.

In contrast to the amines disclosed in the British Pat. No. 1,495,473 the quaternized amines of the present invention, exert a greater retarding of the build-up of basic dyes on polyacrylonitrile whilst giving even dyeings.

The following Examples serve to illustrate the invention. In the Examples all parts are by weight and temperatures are in degrees Centigrade.

EXAMPLE 1

87.2 parts N,N'-bis(3-aminopropyl)ethylenediamine and 400 parts sodium hydroxide (30%) are put in a reaction vessel. After heating to 77° C. with continuous stirring, 379.8 parts benzyl chloride are added dropwise over a period of 45 minutes. The reaction is exothermic and the temperature is allowed to rise to 95° C. After stirring for two hours at 95° C., stirring is discontinued. The reaction product seperates out from the concentrated salt solution in five minutes and collects in the upper phase. The lower layer is removed. The remaining water and a small amount of benzylalcohol is distilled off under vacuum (13 torr) with stirring and heating to 95° C. Subsequently 78.8 parts dimethyl sulphate are added dropwise over a period of 30 minutes so that the temperature is between 90° and 95° C. (the reaction is exothermic). After 1½ hours further stirring the reaction is complete. After the addition of iso-octylphenol-poly(10)glycolether the mixture is stirred still a clear solution is obtained, demineralized water is then added and the product is adjusted to 20% active ingredient for use.

EXAMPLE 2

87.2 parts N,N'-bis(3-aminopropyl)ethylene diamine, 36 parts aminopropyltalgamine (mol. weight approximately 360) and 439 parts 30% sodium hydroxide are put in a reaction vessel. After heating to 70° C. with continuous stirring, 418 parts benzylchloride are added dropwise over a period of 45 minutes. The reaction is slightly exothermic and the temperature rises to 95° C. After two further hours stirring at 90°–95° C. stirring is discontinued. The reaction product separates out of the concentrated salt solution within 5 minutes and gathers in the upper phase. The lower layer is removed. The remaining water and a small amount of benzylalcohol is distilled off with stirring at heating to 98° C. under vacuum (13 torr). Subsequently a further 12.7 parts benzyl chloride are added dropwise at a temperature of 95° to 98° C. After two hours at this temperature, 94.5 parts dimethylsulphate are added dropwise over a period of 45 minutes. 519 parts of a strong, viscous brown solution are obtained after two further hours stirring. With continuous stirring, 674,7 parts iso-octylphenol-poly(10) glycolether are added to the quaternized reaction product so slowly that the temperature does not fall below 80° C. Subsequently stirring is effected at 80° C. until a clear solution is obtained to which 1401 parts water are added with stirring, 2595 parts of a 20% solution may be employed as such, are obtained.

EXAMPLE 3

In analogous manner to the procedure described in Example 2 but employing 87.2 parts N,N'-bis(3-aminopropyl) ethylenediamine, 90 parts aminopropyltalgamine, 498.7 parts 30% sodium hydroxide, 474.7 parts benzylchloride and 189.2 parts dimethylsulphate and 774.6 parts isooctylphenolpoly(10)glycolether, a further levelling agent is prepared, with the exception that a part (250 parts) of the iso-octylphenolpoly(10)-glycolether is added before quaternization.

In analogy with the procedure described in Example 1 but starting with amines given in the Table below, further compounds of formula I are obtained.

TABLE

| Amine | R and $R_1$ | quaternization agent |
|---|---|---|
| $H_2N(CH_2)_3NH(CH_2)_2NH_2$ | benzyl | dimethyl sulphate |
| $H_2N(CH_2)_3NH(CH_2)_3NH(CH_2)_2NH(CH_2)_3NH_2$ | benzyl | dimethyl sulphate |
| $H_2N(CH_2)_3NH(CH_2)_3NH(CH_2)_2NH(CH_2)_3NH(CH_2)_3NH_2$ | benzyl | dimethyl sulphate |

APPLICATION EXAMPLE 100 parts polyacrylonitrile fabric (Orlon 75) are dyed at a liquor to goods ratio of 1:50. The dyebath contains:

2% sodium acetate
4% of 40% acetic acid
3% of product of Example 1 containing 20% active ingredient, and
0.5% dyestuff of formula

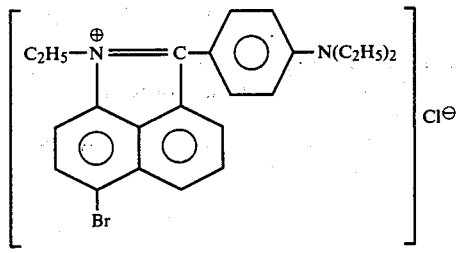

The fabric is introduced at 85°–90° C. into the dyebath which is heated to the boil over the course of approximately 20 minutes. Dyeing is effected at this temperature for 60–90 minutes. An evenly dyed blue dyeing with good fastness is obtained.

If instead of the product of Example 1, the same amount of that of Example 2 of Example 3 or any one of the compounds given in the table in the form of an emulsion containing 20% active ingredient, is used for dyeing in accordance with the procedure described above, an even blue dyeing is obtained.

What is claimed is:

1. A mixture of quaternized amines comprising at least one amine of basic structure of formula I,

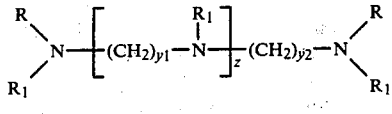

I in which each R, independently, is $(C_{10-22})$alkyl, $(C_{10-22})$alkenyl, phenyl$(C_{1-3})$alkyl or naphthyl$(C_{1-3})$alkyl, each $R_1$, independently, is phenyl$(C_{1-3})$alkyl or naphthyl $(C_{1-3})$alkyl, z is 1 to 5, each $y_1$, independently, is an integer from 2 to 8, $y_2$ is an integer from 2 to 8, with the proviso that when $z=1$ $y_1 \neq y_2$ and when $z>1$ and the $y_1$'s are the same $y_2 \neq y_1$ and at least one amine of basic structure of formula $I_x$,

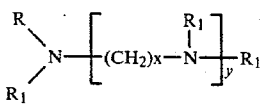

$I_x$ in which

R and $R_1$, respectively, are as defined in formula I, above, x is 2 to 8 and y is 1 to 5, such quaternized amine mixture having an average of 0.5 to 2.0 nitrogen atoms in each amine quaternized with $(C_{1-6})$alkyl radicals.

2. A mixture according to claim 1 which comprises at least one amine of formula Ia

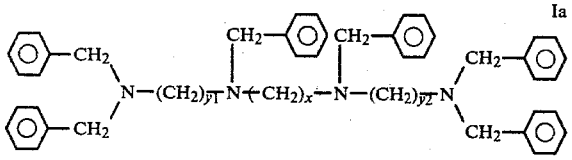

Ia in which $Y_1$ and $Y_2$ are each the same integer from 2 to 8 and, x is an integer from 2 to 8, with the proviso that x is not the same as $Y_1$, and a mixture of amines of formula Ix

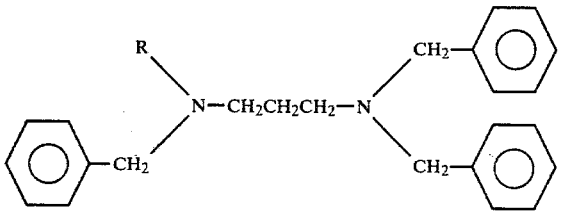

Ix in which R is $C_{14}$ to $C_{22}$ alkyl.

3. A mixture according to claim 2, in which in the compound of formula $I_a$, $y_1$ and $y_2$ are 3 and x is 2.

4. A mixture according to claim 1, in which on average 2 nitrogen atoms of each amine are quaternized.

5. A mixture according to claim 3, in which on average 2 nitrogen atoms of each amine are quaternized.

6. A mixture according to claim 5, in which the nitrogen atoms are quaternized with methyl groups.

7. A mixture according to claim 1, in which the mol ratio of compound of formula $I_x$ to compound of formula I is from 5:95 to 80:20.

8. A mixture according to claim 1 wherein the mol ratio of compound of formula Ix to compound of formula I is 40:60 to 60:40.

9. A mixture according to claim 2 wherein the mol ratio of compound of formula Ix to compound of formula Ia is 40:60 to 60:40.

10. A mixture according to claim 3 wherein the mol ratio of compound of formula Ix to compound of formula Ia is 40:60 to 60:40.

11. A mixture according to claim 5 wherein the mol ratio of compound of formula Ix to compound of formula Ia is 40:60 to 60:40.

* * * * *